US007637375B2

(12) United States Patent
Sattel et al.

(10) Patent No.: US 7,637,375 B2
(45) Date of Patent: Dec. 29, 2009

(54) CHILD-PROOF CARTON PACKAGE

(75) Inventors: Oliver Sattel, Geislingen (DE); Meino Adam, Heidenheim (DE); Jürgen Dambacher, Heidenheim (DE); Dirk Bauernfeind, Bad Wurzach (DE); Peter Fuhrmann, Laupheim (DE); Detlev Gertitschke, Laupheim (DE); Holger Bugar, Schwendi (DE)

(73) Assignees: Carl Edelmann GmbH (DE); Uhlmann Pac-Systeme GmbH & Co. KG (DE)

( * ) Notice: Subject to any disclaimer, the term of this patent is extended or adjusted under 35 U.S.C. 154(b) by 185 days.

(21) Appl. No.: 11/716,291

(22) Filed: Mar. 9, 2007

(65) Prior Publication Data

US 2008/0217390 A1 Sep. 11, 2008

(51) Int. Cl.
*B65D 83/04* (2006.01)

(52) U.S. Cl. ..... 206/531; 206/1.5; 206/539; 229/125.125

(58) Field of Classification Search ..... 206/1.5, 206/528, 530–539, 807; 229/125.125, 132
See application file for complete search history.

(56) References Cited

U.S. PATENT DOCUMENTS 4,125,190 A 11/1978 Davie, Jr. et al.
6,047,829 A 4/2000 Johnstone
6,412,636 B1 7/2002 Jones et al.
6,491,211 B1 12/2002 Evans et al.
6,641,031 B2 * 11/2003 Evans et al. ..... 229/125.125
6,874,636 B2 * 4/2005 Paliotta et al. ..... 206/531
7,090,079 B2 * 8/2006 Ehrlund ..... 206/531
2004/0232033 A1 11/2004 Paliotta et al.
2006/0131205 A1 * 6/2006 Sandberg et al. ..... 206/538

FOREIGN PATENT DOCUMENTS

EP 1 002 744 A1 5/2000
EP 1 057 744 A1 12/2000
EP 1 270 440 B1 12/2003
WO WO 03/101840 A 12/2003

* cited by examiner

*Primary Examiner*—Luan K Bui
(74) *Attorney, Agent, or Firm*—Jansson Shupe & Munger Ltd.

(57) ABSTRACT

A childproof package consists of a rectangular folding box of cardboard with at least one strip-like blister pack inside, which can be pulled out from one of the short, narrow sides of the folding box. The folding box is designed so that it can be reclosed in such a way as to be childproof again, and the folding box and the blister pack have cooperating means, which are designed so that the blister pack cannot be pulled completely out of the folding box.

5 Claims, 1 Drawing Sheet

CHILD-PROOF CARTON PACKAGE

FIELD OF THE INVENTION

The invention pertains to a package consisting of a rectangular folding box of cardboard with at least one strip-like blister pack inside, which can be pulled out from one of the short, narrow sides of the box.

PRIOR ART

Packages of this type are known in general in the form of medication packages. The blister pack (referred to in the following as "the blister") consists of a strip of stiff plastic material, in which deep-drawn wells are formed, which hold the pills, tablets, capsules, suppositories, etc. After the wells have been filled, they are sealed by a cover foil of limited tensile strength, which is bonded to the plastic strip. This cover foil usually consists of metal, especially aluminum. To remove the medication from the well, the medication is pushed from the rear of the strip against the cover foil, which is thus broken open. It is obvious that the stiffness of the plastic strip material in the area of the well has been reduced to such an extent, usually by the deep-drawing process itself, that it is possible to deform the well by manual pressure.

BACKGROUND OF THE INVENTION

Blisters of this type are not so tamper-proof that it would be impossible, during unsupervised play, for small children to gain access to the medication present in the blister. The legislator will prescribe soon that a primary packaging means—in the present case, a blister which can be completely removed from a folding box—must be childproof. Making a blister childproof, however, demands a relatively expensive design. An example of this is described in EP 1 270 440 B1. Additional prior art involving childproof blisters can be found in U.S. Pat. No. 4,125,190 A, EP 1 057 744 A2, EP 1 002 744 A1, and U.S. Pat. No. 6,047,829 A, to name only a few. Most of these previously known blister packages, however, are childproof only up to the time they are first opened. Once the package has been broken open and is lying around without supervision, it can represent a danger to small children.

The invention is based on the task of providing a package of the type indicated above which, after it has been opened the first time, can be reclosed in such a way as to be childproof again in the legal sense.

This task is accomplished for a package of the type indicated above in that the folding box is designed to be reclosable in a childproof sense, and in that the folding box and the blister package have cooperating means which are designed to prevent the blister pack from being removed completely from the folding box.

SUMMARY OF THE INVENTION

Because, according to the present invention, the folding box and the blister are connected inseparably to each other, the folding box belongs to the primary packaging means and can therefore fulfill the childproofing function as prescribed by law, whereas the blister itself can remain unsecured, i.e. un-childproofed.

The invention proceeds from the train of thought that an adult who has opened a package of the inventive type for the first time to remove a tablet will not leave the packaging lying around open, for in this state the package represents clutter and is in general inconvenient to find and use. Instead, the adult will be induced by the type of packaging to push the blister back into the folding box and to close the folding box, as a result of which the childproofing function is reestablished to the extent that this has not already happened by itself simply by the insertion of the blister into the folding box, as will be the case in the preferred embodiment of the invention.

In a preferred embodiment of the invention, a latching projection is formed on the blister, whereas the folding box has a catch, formed out of cardboard and pressed elastically into a closed position. This catch acts in the same way as a door catch and, when in a closed position, engages detachably with the latching projection under elastic pretension. Pulling the blister out of the folding box requires two movements in two different directions which are perpendicular to each other. That is, the catch must first be detached in a direction transverse to the longitudinal dimension of the blister, and then the blister must be pulled out longitudinally from the folding box. Performing this sequence of operations appears simple but exceeds the capacity of a small child.

To make it impossible for the blister to be pulled completely out of the package—as a result of which the folding box becomes part of the primary packaging in the legal sense—a locking device is formed in the folding box to limit the travel of the latching projection on the blister as the blister is being pulled out of the folding box. It would also be possible, however, to provide the blister with a tongue, which is bent over in the direction opposite that in which the blister is pulled out of the folding box. As the blister is being pulled out, this tongue is caught by a cardboard tab, which projects into the interior of the folding box.

In a preferred embodiment of the invention, the blister consists of two strips of unequal length, which are connected integrally to each other at two crease lines, which are parallel to each other and a certain distance apart and which are transverse to the longitudinal dimension of the package. The two strips are thus connected by a web, the boundaries of which are formed by the crease lines. The dimensions of the web are such that it fills up the free cross section of the interior of the folding box. The length of the shorter strip is such that, after the blister has been pulled out of the folding box as far as possible, this strip can be freely unfolded upward. In the state in which the blister is pushed into the folding box, however, the web forms one of the narrow sides of the rectangular package and thus closes off the folding box at one end.

According to an advantageous elaboration of a blister of the type just described above, the shorter strip is provided on the side facing the adjacent wall of the folding box with a projecting stop bump near the crease line forming the boundary of this strip. The stop bump has a slanted surface, which descends toward the adjacent crease line and terminates at the surface of the strip. A locking flap is hinged to the previously mentioned wall of the body of the folding box. This flap proceeds from the narrow-side opening of the folding box body and extends into the folding box body but is not glued there. The flap has an opening, against the edge of which the stop bump of the blister rests when the blister is pushed completely into the folding box. This prevents the shorter strip of the blister from being pushed so far into the folding box from the outside that the web fails to form a flush closure of the folding box. The narrow side wall of the package formed by the web of the blister thus retains its stability. The same effect can also be obtained according to an alternative by forming a projection on the longer strip of the blister, this projection extending toward the shorter strip. The free edge of the shorter strip rests against this projection after the blister has been folded together and pushed into the folding box.

So that the blister can be pulled out of the folding box more easily, it is advantageous in packages of the type just described to provide at least one of the body walls of the folding box with a finger opening, through which the blister can be gripped. This opening will be located in the area where the web of the blister forms one of the shorter narrow sides of the package.

SHORT DESCRIPTION OF THE FIGURES

The invention is described in greater detail below with reference to a preferred exemplary embodiment, illustrated in the drawings.

EXPLANATION OF A PREFERRED EMBODIMENT OF THE INVENTION

Figure 1:
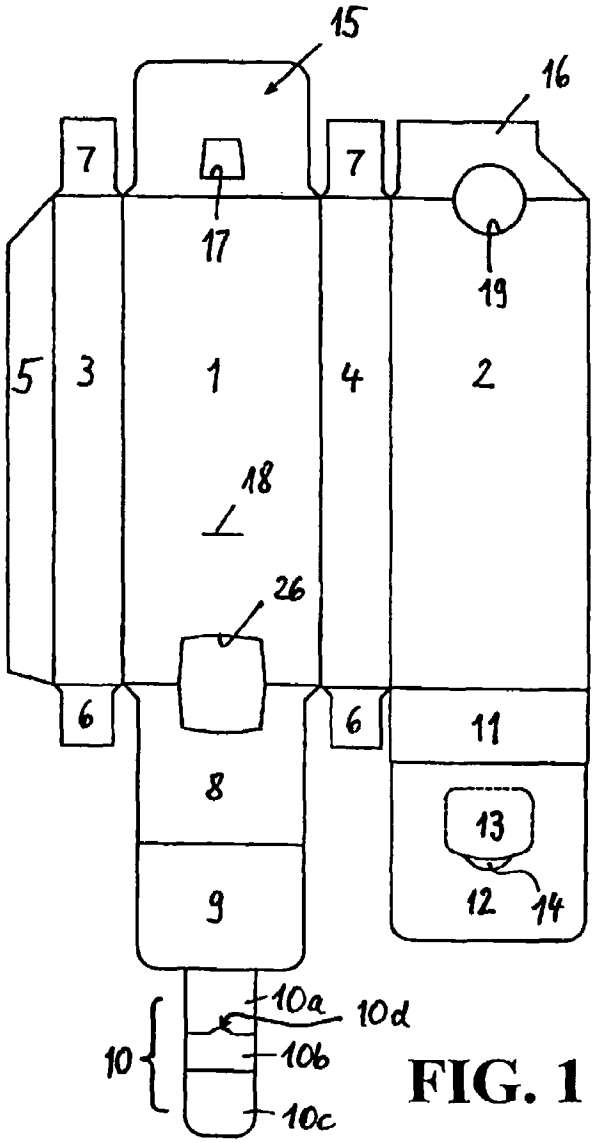
FIG. 1 shows a flat cardboard blank for a folding box according to the preferred embodiment of the invention.

FIG. 1 shows the flat blank of a folding box of cardboard, consisting of two wide body panels 1, 2; two narrow body panels 3, 4, which are connected to each other by fold lines; and a glue tab 5, which adjoins the outer narrow body panel 3. Adjacent to the ends of the narrow body panels 3 and 4 are first and second glue tabs 6, 7. A retaining flap 8 adjoins the first end of the inner body panel 1 at a fold line. Adjacent to this retaining flap there is an elastic tab 9, connected again by way of a fold line. This tab carries an extension in the form of a tab 10, which consists of three segments 10*a*, 10*b*, and 10*c*. At the fold line which connects segment 10*a* to segment 10*b*, an arc-shaped cut 10*d* is made in the middle, which forms a projection on the segment 10*b*.

At the fold line which connects the body panel 1 to the retaining flap 8, there is an opening 26 in the blank, which extends symmetrically into the two previously mentioned panels of the box.

The second wide body panel 2 carries at one end a cover flap 11, which continues in the form of a wide glue tab 12. A window panel 13, framed by a line of intentionally weaker material and forming an integrity seal, is provided in the wide glue tab 12. The boundary line around the window panel is perforated, and next to the panel is a crescent moon-shaped opening 14. At the opposite end, the wide body panel 1 has a wide locking flap 15, and the wide body panel 2 has a stiffening flap 16. The locking flap 15 has an opening 17 near the fold line connecting it to the body panel 1.

This folding box blank is processed as follows. The retaining flap 8 is folded onto the inside surface of the body panel 1 and glued there. The elastic tab 9 is folded back over toward the retaining flap 8; the tab 10 is guided through the cut-out formed by the opening 26 and positioned in such a way that the fold line which connects segments 10*a* and 10*b* to each other is at the level of the transverse boundary line, i.e. the bottom edge, of the cut-out formed by the opening 26. The segment 10*c* is then glued to the outside surface of the body panel 1; its end will then be located in the position indicated in FIG. 1 by the short line 18.

The glue tabs 7 and the reinforcing tab 16 are bent over and glued to their corresponding cardboard panels 3, 4, and 2. The reinforcing tab does not have to be glued down, if desired. The locking flap 15 is folded inward but not glued. Then the blister in question is inserted (see FIG. 2), and the folding box body is closed. The glue tab 5 is now glued to the inside surface of the body panel 2; the outside surfaces of the glue tabs 6 are glued to the cover panel 11; and the wide glue tab 12 is glued to the outside surface of the body panel 1, where it covers the segments 10*b* and 10*c* of the tab 10.

Figure 2:
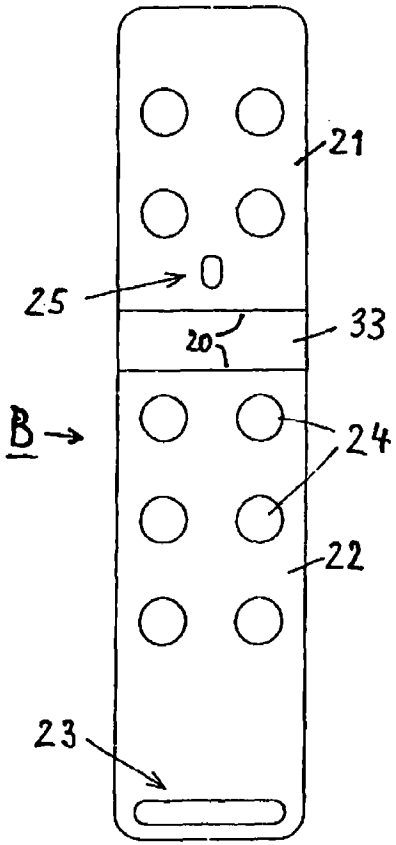
FIG. 2 shows the blister designed to fit in the folding box according to FIG. 1.

FIG. 2 shows the blister B in the unfolded state, before it has been inserted into the box and the box closed. The blister B consists of a stiff plastic material and is in the form of a long strip, which is divided by two parallel crease lines 20 into a shorter section 21 and a longer section 22. The longer section 22 has at one end a pleat 23, which projects out from the same side as the wells 24 formed in the blister B. The shorter section 21 has a bump 25, which is near the crease line 20 forming the boundary of this section and projects toward the opposite side. The bump has a slanted upper surface, which rises above the blister B as it proceeds away from the crease line 20.

Figure 3:
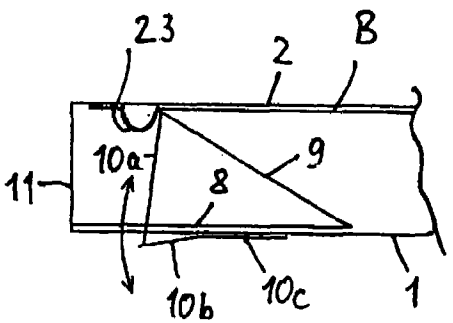
FIG. 3 shows a cut-out in schematic, cross-sectional view, which serves the understanding of the function of the safety seal in the embodiment of FIGS. 1 and 2.

When the blister B is inside the closed folding box, the pleat 23 is located behind a catch, as shown in FIG. 3, which is formed by the elastic tab 9 and the segments 10*a* and 10*b* of the tab 10. The bump 25 is located in the opening 17 in the retaining flap 15.

When the window panel 13 forming the integrity seal is broken out of the panel 12 along its perforations, the projection formed on the segment 10*b*, the edge of which is defined by the arc-shaped cut 10*d*, becomes accessible, and it is then possible to pull on the segment and thus to move the previously mentioned catch, formed by the elastic tab 9, out of the way of the pleat 23, as can be seen clearly in FIG. 3, as a result of which the blister B can then be pulled out of the folding box. This is facilitated by the finger hole, which is created by the circular opening 19. The blister B can be pulled out of the folding box until the pleat 23 strikes the free edge of the elastic locking flap 15. Because the section 21 of the blister B is shorter than the other section 22 carrying the pleat 23, this longer section being as long as the folding box, the shorter section 21 can be unfolded without interference from the folding box.

After a tablet has been removed, the blister B can be pushed back into the folding box, during which process the pleat 23 slides over the elastic tab 9 and latches behind it. The shorter section 21 of the blister B cannot be pushed in too far, because the bump 25 on it is stopped by the opposing edge of the opening 17 in the elastic locking flap 15.

Even after the integrity seal formed by the window panel 13 has been removed, the package is still childproof, because children of an age who must be prevented from accessing medication packages are not able to coordinate the previously mentioned sequence of movements simultaneously, namely, disengaging the latch and pulling the blister out of the folding box.

The invention claimed is:

1. A childproof resealable package consisting of a rectangular folding box of cardboard, said package comprising:

two long wide sides;

two short-narrow sides formed by walls and flaps and having glue tabs;

first and second ends which with the walls define an interior, the first end being a withdrawal end and the second end being a closed end;

at least one strip-like blister pack inside the interior of the folding box from which said blister pack is withdrawable from the withdrawal end;

a catch formed on the closed end of the folding box including a retaining flap, an elastic tab and a tab, a latching projection formed on the blister pack, wherein, in a closed position in the interior the latching projection engages detachably with the catch under an elastic pretension;

wherein the folding box is designed to be reclosable in such a way as to be resealable, the folding box and the blister pack being configured and arranged to prevent withdrawal of the blister pack from the folding box.

2. The package according to claim 1 in which the blister pack consists of two strips of unequal length, a shorter strip and a longer strip, which are connected integrally to each other at two crease lines which are a certain distance apart and parallel to each other, the crease lines extending transversely to a longitudinal dimension of the package, the strips thus being connected to each other by a web, which extends between the crease lines;

the dimensions of the web are such that it fills up a free cross section of the interior space of the folding box; and the length of the shorter strip is such that it can be unfolded freely upward after the blister pack has been pulled as far as possible from the folding box.

3. The package according to claim 2 in which the shorter strip has a projecting stop bump on a side facing an adjacent wall of the folding box, the bump having a slanted surface which descends toward the crease line and terminates at the surface of the strip; and a locking flap proceeding from the withdrawal end of the folding box is hinged to the adjacent wall of the folding box, the locking flap extends into the interior but is not glued there, the locking flap being provided with an opening, at the edge of which the stop bump on the blister pack rests when the blister pack is fully inserted into the folding box.

4. The package according to claim 2 in which a finger opening is located in the area where the web of the blister pack forms one of the short-narrow sides of the package, so that the blister pack can be gripped.

5. The package according to claim 3 in which a finger opening is located in the area where the web of the blister pack forms one of the short-narrow sides of the package, so that the blister pack can be gripped.

* * * * *